US009699850B1

(12) United States Patent
Jin et al.

(10) Patent No.: US 9,699,850 B1
(45) Date of Patent: Jul. 4, 2017

(54) POWER CIRCUIT AND RELATED METHOD FOR LED LIGHTING DEVICE

(71) Applicant: ZHEJIANG SHENGHUI LIGHTING CO., LTD, Jiaxing (CN)

(72) Inventors: Changzhou Jin, Jiaxing (CN); Yehua Wan, Jiaxing (CN); Lifeng Ling, Jiaxing (CN)

(73) Assignee: ZHEJIANG SHENGHUI LIGHTING CO., LTD, Jiaxing (CN)

( * ) Notice: Subject to any disclaimer, the term of this patent is extended or adjusted under 35 U.S.C. 154(b) by 9 days.

(21) Appl. No.: 15/022,371

(22) PCT Filed: Mar. 10, 2015

(86) PCT No.: PCT/CN2015/073959
§ 371 (c)(1),
(2) Date: Mar. 16, 2016

(87) PCT Pub. No.: WO2015/196832
PCT Pub. Date: Dec. 30, 2015

(30) Foreign Application Priority Data

Jun. 26, 2014 (CN) ..... 2014 1 0299009

(51) Int. Cl.
*H05B 33/08* (2006.01)

(52) U.S. Cl.
CPC ..... *H05B 33/0845* (2013.01); *H05B 33/0827* (2013.01); *H05B 33/0857* (2013.01)

(58) Field of Classification Search
CPC ..... H05B 37/0272; H05B 33/0815; H05B 33/0845; H05B 37/0227; H05B 33/0809;
(Continued)

(56) References Cited

U.S. PATENT DOCUMENTS

2011/0080110 A1* 4/2011 Nuhfer ..... H05B 33/0815 315/291
2013/0002163 A1* 1/2013 He ..... H05B 33/0815 315/228
2014/0091720 A1* 4/2014 Brinlee ..... H05B 33/0815 315/186

FOREIGN PATENT DOCUMENTS

CN 1288348 A 3/2001
CN 103347334 A 10/2013
(Continued)

OTHER PUBLICATIONS

The World Intellectual Property Organization (WIPO) International Search Report for PCT/CN2015/073959 May 29, 2015.

*Primary Examiner* — Douglas W Owens
*Assistant Examiner* — Wei Chan
(74) *Attorney, Agent, or Firm* — Anova Law Group, PLLC

(57) ABSTRACT

A power circuit for an LED lighting device including an AC power supply, a dimmer and a control circuit is provided. The control circuit includes a filtering unit configured to filter a voltage signal coming from the dimmer and a rectifying unit configured to receive the signal outputted from the filtering unit and rectify the signal to a DC signal. The control circuit also includes a transformer unit connected to the rectifying unit. Further, the control circuit includes a dimmer phase detection unit configured to sample the rectified voltage signal at point K and convert the voltage signal to a low voltage pulse signal and a flyback conversion unit configured to receive the pulse signal outputted by the dimmer phase detection unit and adjust a current flowed through the transformer unit and a first transistor to control the output current to the LED lighting device.

15 Claims, 4 Drawing Sheets

(58) Field of Classification Search
CPC H05B 33/0854; H05B 33/083; H05B 33/089; H05B 33/0803; H05B 33/0851; H05B 33/0857
USPC ..... 315/291, 86, 307, 122, 224, 294, 127, 315/152
See application file for complete search history.

(56) References Cited

FOREIGN PATENT DOCUMENTS

| | | | |
|---|---|---|---|
| CN | 104066249 | A | 9/2014 |
| CN | 203984735 | U | 12/2014 |
| DE | 4430359 | A1 | 3/1996 |

* cited by examiner

POWER CIRCUIT AND RELATED METHOD FOR LED LIGHTING DEVICE

CROSS-REFERENCES TO RELATED APPLICATIONS

This application is a national stage application under 35 USC §371(c) of PCT Application No. PCT/CN2015/073959, entitled "POWER CIRCUIT AND RELATED METHOD FOR LED LIGHTING DEVICE," filed on Mar. 10, 2015, which claims priority to Chinese Patent Application No. 201410299009.7, filed on Jun. 26, 2014. The entire disclosure and contents of the above applications are hereby incorporated by reference herein.

FIELD OF THE INVENTION

The present disclosure generally relates to the field of light emitting diode (LED) lighting technology and, more particularly, relates to a power circuit and a method for an LED lighting device.

BACKGROUND

LED lighting may generally provide advantages in energy conservation, environmental protection, controllable lighting, solid-state lighting, and long operational lifetime. LED lamps thus have been widely used in various areas for public, commercial, and/or indoor lighting.

Often, LED lamps may have lamp-head structures generally designed similar to incandescent lamps, energy saving lamps, and other conventional lamps. Presumably, LED lamps may be used to replace other conventional lamps by an easy installation without changing the original structures of a lighting system including other conventional lamps.

However, when other conventional lamps are replaced by LED lamps, dimming feature of the LED lamps may not be applied, because the LED lamps do not include any dimmers to implement the dimming feature of the replaced LED lamps. To add a dimmer in those conventional systems can increase the cost in use and can require complicated and additional installation. In addition, when the conventional lamps are replaced by the LED lamps, the existing dimmers cannot be used to perform color control operations for the LED lamps.

The disclosed LED power circuits and driving methods are directed to solve one or more problems set forth above and other problems.

BRIEF SUMMARY OF THE DISCLOSURE

One aspect of the present disclosure includes a power circuit for an LED lighting device. The power circuit includes an AC power supply, a dimmer and a control circuit. The control circuit includes a filtering unit configured to filter a voltage signal coming from the dimmer and output the filtered voltage signal and a rectifying unit configured to receive the signal outputted from the filtering unit, rectify the signal to a DC signal and output the DC signal. The control circuit also includes a transformer unit connected to the rectifying unit, where the transformer unit includes a primary coil and a secondary coil. Further, the control circuit includes a dimmer phase detection unit configured to sample the rectified voltage signal at point K, convert the voltage signal to a low voltage pulse signal, and output the converted low voltage pulse signal and a flyback conversion unit configured to receive the pulse signal outputted by the dimmer phase detection unit and adjust a current flowed through the transformer unit and a first transistor to control the output current of the LED lighting device based on the pulse signal. One end of the flyback conversion unit is connected to the dimmer phase detection unit, and the other end of the flyback conversion unit is connected to the first transistor and the primary coil of the transformer unit.

Another aspect of the present disclosure includes a method for powering up an LED lighting device. The method includes turning on a power supply switch of the LED lighting device and filtering a voltage signal coming from a dimmer and outputting the filtered voltage signal when performing a dimming control operation for the LED lighting device. The driving method also includes rectifying the outputted voltage signal to a direct current signal, sampling a rectified voltage signal at point K, converting the sampled voltage signal to a low voltage pulse signal and transmitting the low voltage pulse signal to a flyback conversion unit. Further, the driving method includes adjusting a current flowed through a transformer unit and a first transistor by the flyback conversion unit based on the pulse signal, and controlling the output current of the LED lighting device.

Another aspect of the present disclosure includes a power circuit for an LED lighting device including an alternative current (AC) power supply, a dimmer and a control circuit. The control circuit includes a filtering unit configured to filter a voltage signal coming from the dimmer and output a filtered voltage signal; a rectifying unit configured to receive the signal outputted from the filtering unit and output a direct current signal; and a transformer unit, including a primary coil and a secondary coil. The control circuit further includes a dimmer phase detection unit configured to sample a rectified voltage signal at point K and output a converted low voltage pulse signal; and a flyback conversion unit configured to receive the pulse signal outputted by the dimmer phase detection unit and adjust a current flowed through the transformer unit and a first transistor to control the output current of the LED lighting device accordingly.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

Figure 1:
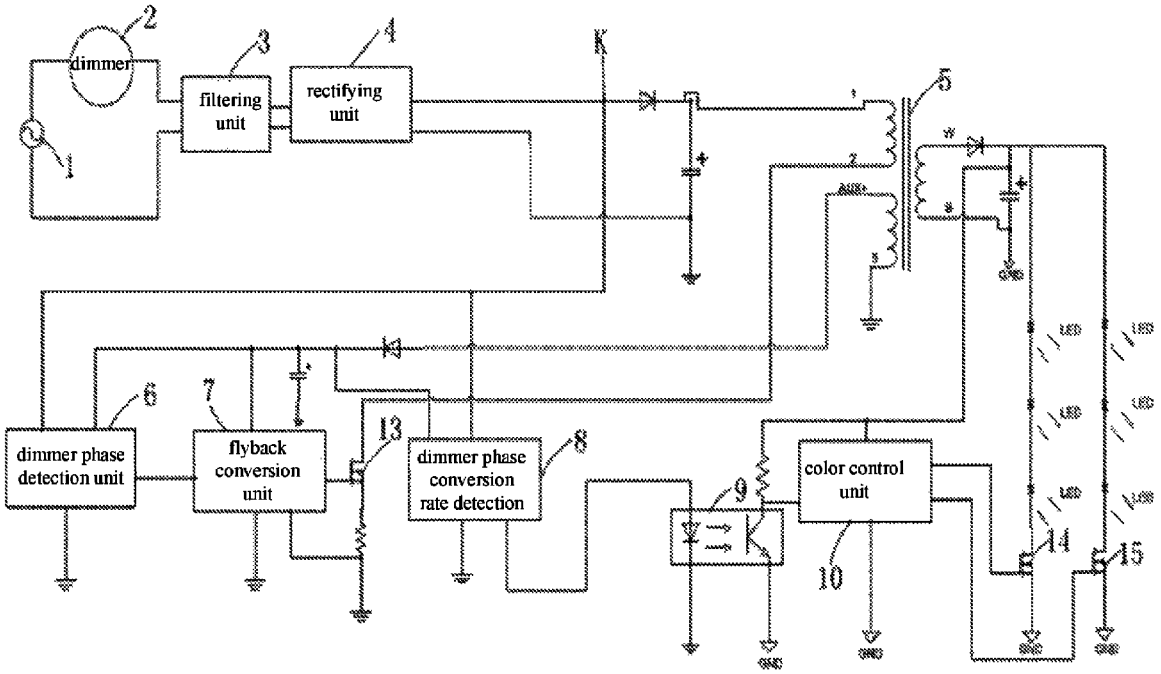
FIG. 1 illustrates a structure diagram of an exemplary LED power circuit consistent with the disclosed embodiments.

FIG. 1 illustrates a structure diagram of an exemplary LED power circuit consistent with the disclosed embodiments. As shown in FIG. 1, the LED power circuit may include an alternating current (AC) power supply 1, a dimmer 2 and a control circuit 12, where the AC power supply 1 and the dimmer 2 can be existing structures that are widely used by conventional lighting systems. The control circuit 12 is an important component. The control circuit 12 may include a filtering unit 3, a rectifying unit 4, a transformer unit 5 which is connected to the rectifying unit 4, a dimmer phase detection unit 6, a flyback conversion unit 7, a dimmer phase conversion rate detection unit 8, an opto-isolator 9, a color control unit 10, a first transistor 13, a second transistor 14 and a third transistor 15.

One end of the flyback conversion unit 7 is connected to the dimmer phase detection unit 6, and the other end of the flyback conversion unit 7 is connected to a primary coil of the transformer unit 5 and the first transistor 13. The first transistor 13 includes a grid electrode, a drain electrode and a source electrode. The grid electrode of the first transistor 13 is connected to the flyback conversion unit 7. The drain electrode of the first transistor 13 is connected to the primary coil of the transformer unit 5. A secondary coil of the transformer unit 5 is connected to two rows of LED lighting devices with different colors, wherein the LED lighting devices in the same row have the same color.

The second transistor 14 and the third transistor 15 include a grid electrode, a drain electrode and a source electrode, respectively. The grid electrodes of the second transistor 14 and the third transistor 15 are connected to the color control unit 10. The drain electrode of the second transistor 14 is connected to one row of the LED lighting devices. The drain electrode of the third transistor 15 is connected to the other row of the LED lighting devices.

The operating process of the power circuit of the LED lighting device is described as follows. When the dimmer 2 performs a dimming control operation, at first, a voltage signal coming from the dimmer 2 is filtered by the filtering unit 3. Then, the filtered voltage signal is rectified by the rectifying unit 4 and converted to a direct current (DC) signal. The dimmer phase detection unit 6 samples a rectified voltage signal at point K and converts the sampled voltage signal to a low voltage signal to transmit to the flyback conversion unit 7. Based on the voltage signal, the flyback conversion unit 7 adjusts the magnitude of a current that flows through the transformer unit 5 and the first transistor 13, thereby controlling the magnitude of the output current of the LED lighting device. In normal lighting situations, only one row of the LED lighting devices would be bright. The dimmer 2 would control the brightness of this row of the LED lighting devices.

The dimmer phase conversion rate detection unit 8 detects the voltage at point K in real-time and compares the voltage at point K with a reference voltage. Then, the dimmer phase conversion rate detection unit 8 outputs a pulse signal. The pulse signal outputted by the dimmer phase conversion rate detection unit 8 passes through the opto-isolator 9 and is sent to the color control unit 10. Based on duty cycle changes of the pulse signal within a certain period of time, the color control unit 10 controls the second transistor 14 and the third transistor 15 to be turned on and turned off, thus controlling color status of the LED lighting device.

If a non-isolation circuit is utilized, the opto-isolator may not be used. The pulse signal outputted by the dimmer phase conversion rate detection unit is transmitted to the color control unit 10 directly.

Specifically, the process for performing the dimming control operation and the color control operation for the LED lighting device is described as follows.

When the dimmer 2 performs the dimming control operation for the LED lighting device, a user may rotate a knob of the dimmer 2. The dimmer phase detection unit 6 detects the rectified voltage signal at point K. The dimmer phase detection unit 6 converts a phase cut signal of the dimmer 2 to a voltage signal and transmits the voltage signal to the flyback conversion unit 7. Based on the magnitude of the received voltage signal, the flyback conversion unit 7 adjusts the operating pulse width of the flyback conversion unit 7, thereby changing the magnitude of the current outputted by the power circuit and realizing the dimming control operation for the LED lighting device.

When the dimmer 2 performs the color control operation for the LED lighting device, the user needs to rotate back and forth the knob of the dimmer from clockwise 120 degrees to counterclockwise 120 degrees (specific angles can be adjusted according to different dimmers) within 1-2 seconds, or rotate back and forth the knob of the dimmer from counterclockwise 120 degrees to clockwise 120 degrees within 1-2 seconds. Therefore, the phase of the dimmer changes from large to small and from small to large in a short period of time, or the phase of the dimmer changes from small to large and from large to small in the short period of time. The dimmer phase conversion rate detection unit 8 detects the voltage at point K, and converts the phase change of the dimmer 2 in the short period of time to pulse time variation signal of the voltage. The pulse time variation signal passes through the opto-isolator 9 and is transmitted to the color control unit 10. Based on the time change of the pulse voltage signal, the color control unit 10 controls the second transistor 14 and the third transistor 15 to be turned on and turned off, thereby alternatively turning on and turning off the two rows of the LED lighting devices, and realizing color changes.

If the dimmer 2 is a sliding type phase cut dimmer, when performing the color control operation for the LED lighting device, the user only needs to slide the dimmer and make the phase of the dimmer change from large to small or from small to large in a short period of time. Therefore, the user can adjust the color of the LED lighting device by using the conventional dimmer, and the user can also adjust the brightness for different colors of the LED lighting device by using the conventional dimmer.

In addition, two rows of LED lighting devices are set in the present embodiment, and the two rows of LED lighting devices correspond to the transistor 14 and the transistor 15, respectively. Also, multiple rows of LED lighting devices can be set according to needs and the multiple rows of LED lighting devices may correspond to multiple transistors.

Figure 2:
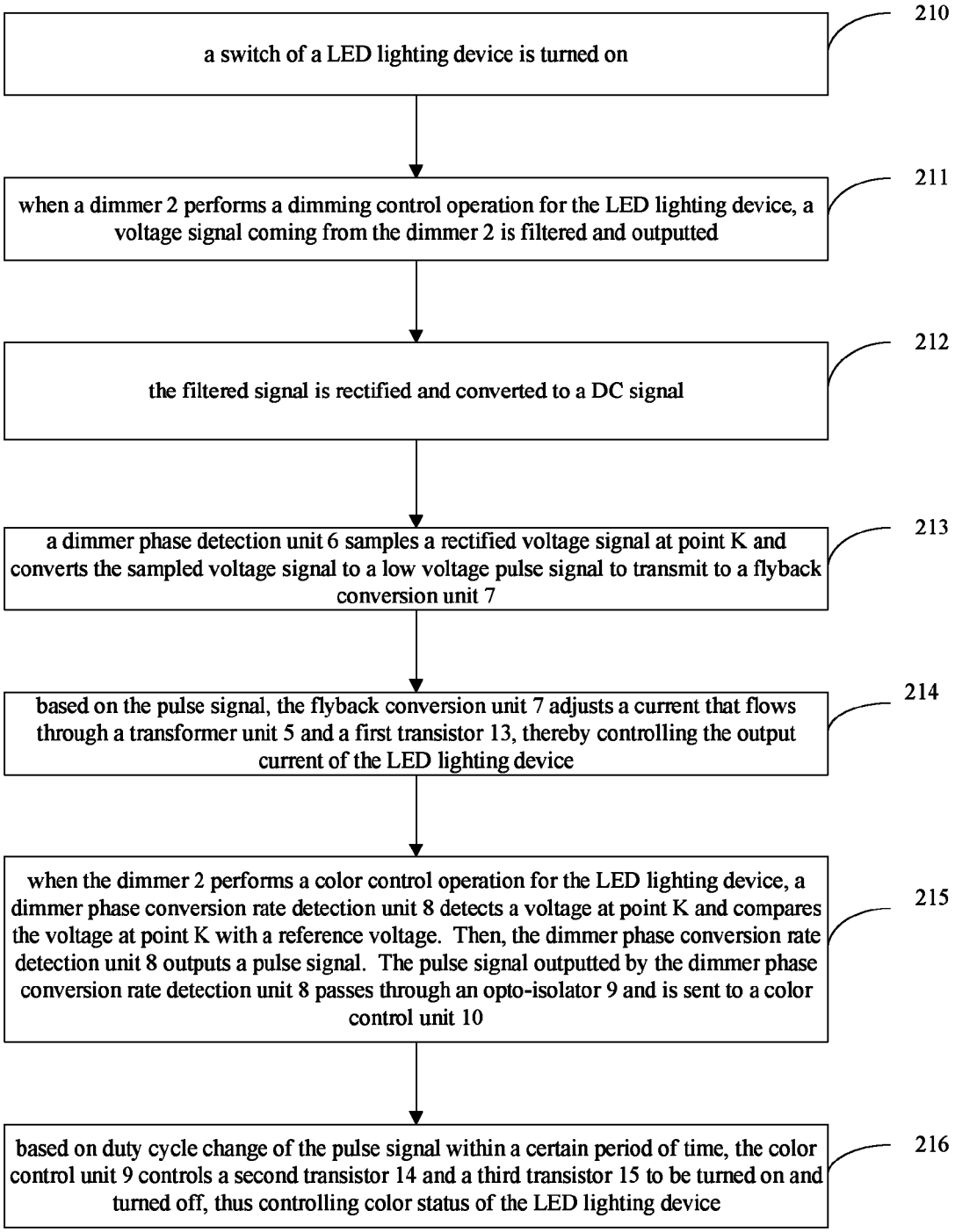
FIG. 2 illustrates a flow chart of an exemplary LED driving method consistent with the disclosed embodiments.

FIG. 2 illustrates a flow chart of an exemplary LED powering method consistent with the disclosed embodiments. As shown in FIG. 2, the process may include the following steps.

Step 210: a switch of an LED lighting device is turned on.

Step 211: when a dimmer 2 performs a dimming control operation for the LED lighting device, a voltage signal coming from the dimmer 2 is filtered and outputted.

Step 212: the filtered signal is rectified and converted to a DC signal.

Step 213: a dimmer phase detection unit 6 samples a rectified voltage signal at point K and converts the sampled voltage signal to a low voltage pulse signal to transmit to a flyback conversion unit 7.

Step 214: based on the pulse signal, the flyback conversion unit 7 adjusts the magnitude of a current that flows through a transformer unit 5 and a first transistor 13, thereby controlling the magnitude of the output current of the LED lighting device.

Step 215: when the dimmer 2 performs a color control operation for the LED lighting device, a dimmer phase conversion rate detection unit 8 detects a voltage at point K and compares the voltage at point K with a reference voltage. Then, the dimmer phase conversion rate detection unit 8 outputs a pulse signal. The pulse signal outputted by the dimmer phase conversion rate detection unit 8 passes through an opto-isolator 9 and is sent to a color control unit 10.

Step 216: based on the duty cycle change of the pulse signal within a certain period of time, the color control unit 9 controls a second transistor 14 and a third transistor 15 to be turned on and turned off, thus controlling the light color of the LED lighting device.

Figure 3:
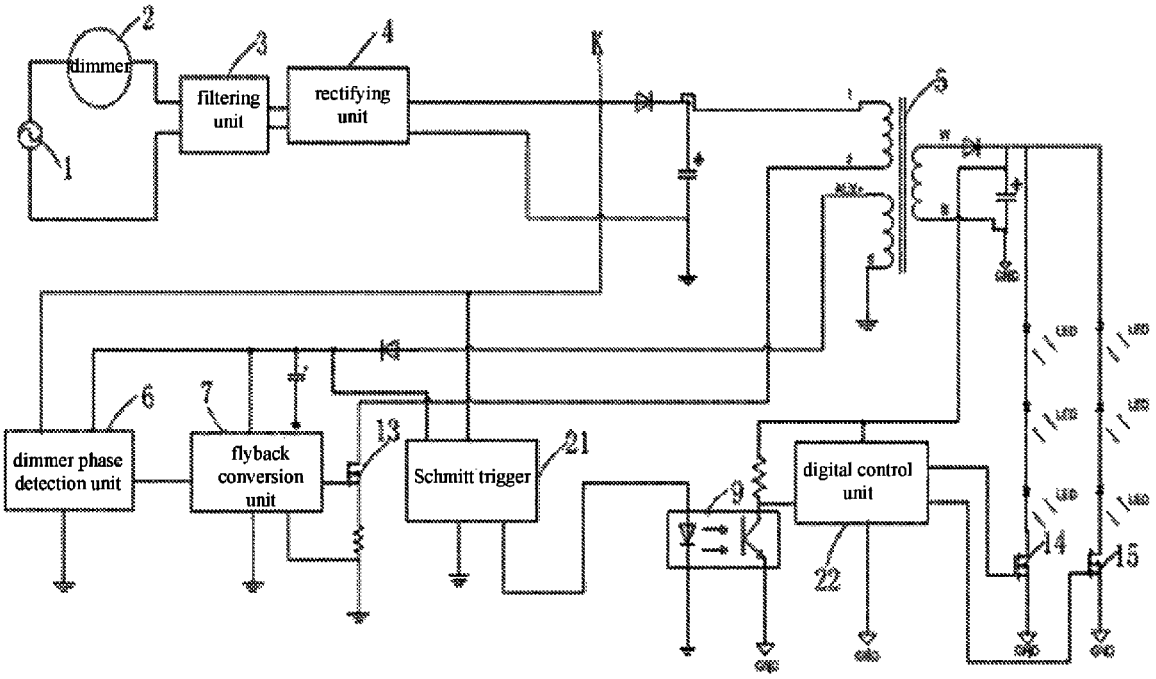
FIG. 3 illustrates a structure diagram of another exemplary LED power circuit consistent with the disclosed embodiments.

FIG. 3 illustrates a structure diagram of another exemplary LED power circuit consistent with the disclosed embodiments. As shown in FIG. 3, the LED power circuit may include an AC power supply 1, a dimmer 2 and a control circuit 12, where the AC power supply 1 and the dimmer 2 can be existing structures that are widely used by conventional lighting systems. The control circuit 12 may include a filtering unit 3, a rectifying unit 4, a transformer unit 5 which is connected to the rectifying unit 4, a dimmer phase detection unit 6, a flyback conversion unit 7, a Schmitt trigger 21, an opto-isolator 9, a digital control unit 22, a first transistor 13, a second transistor 14 and a third transistor 15.

One end of the flyback conversion unit 7 is connected to the dimmer phase detection unit 6, and the other end of the flyback conversion unit 7 is connected to a primary coil of the transformer unit 5 and the first transistor 13. The first transistor 13 includes a grid electrode, a drain electrode and a source electrode. The grid electrode of the first transistor 13 is connected to the flyback conversion unit 7. The drain electrode of the first transistor 13 is connected to the primary coil of the transformer unit 5. A secondary coil of the transformer unit 5 is connected to two rows of LED lighting devices with different colors, where the LED lighting devices in the same row have the same color.

The second transistor 14 and the third transistor 15 include a grid electrode, a drain electrode and a source electrode, respectively. The grid electrodes of the second transistor 14 and the third transistor 15 are connected to the digital control unit 22. The drain electrode of the second transistor 14 is connected to one row of the LED lighting devices. The drain electrode of the third transistor 15 is connected to the other row of the LED lighting devices.

The operating process of the power circuit of the LED lighting device is described as follows. When the dimmer 2 performs a dimming control operation, at first, a voltage signal coming from the dimmer 2 is filtered by the filtering unit 3. Then, the filtered voltage signal is rectified by the rectifying unit 4 and converted to a DC signal. The dimmer phase detection unit 6 samples a rectified voltage signal at point K and converts the sampled voltage signal to a low voltage signal to transmit to the flyback conversion unit 7. Based on the voltage signal, the flyback conversion unit 7 adjusts the magnitude of a current that flows through the transformer unit 5 and the first transistor 13, thereby controlling the magnitude of the output current of the LED lighting device. In a normal lighting situation, only one row of the LED lighting devices is bright. The dimmer 2 controls the brightness of this row of the LED lighting devices.

Phase change generated when a knob of the dimmer rotates is converted to the change of pulse width of a square wave through the Schmitt trigger 21. The changing square wave signal is transmitted to the digital control unit 22. The digital control unit 22 identifies amplitude and rate of the phase change of the dimmer 2 by collecting data of the pulse width of the square wave and performing algorithm analysis, thereby controlling the second transistor 14 and the third transistor 15 to be turned on and turned off. Therefore, two rows of lighting devices with different colors are turned on and turned off alternatively, realizing color changes.

If a non-isolation circuit is utilized, the opto-isolator may not be used. The pulse signal outputted by the dimmer phase conversion rate detection unit is transmitted to the digital control unit 22 directly.

Specifically, the process for performing the dimming control operation and the color control operation for the LED lighting device is described as follows.

When the dimmer 2 performs the dimming control operation for the LED lighting device, a user may rotate ae knob of the dimmer 2. The dimmer phase detection unit 6 detects the rectified voltage signal at point K. The dimmer phase detection unit 6 converts a phase cut signal of the dimmer 2 to a voltage signal and transmits the voltage signal to the flyback conversion unit 7. Based on the magnitude of the received voltage signal, the flyback conversion unit 7 adjusts the operating pulse width of the flyback conversion unit 7, thereby changing the magnitude of the current outputted by the power circuit and realizing the dimming control operation for the LED lighting device.

When the dimmer 2 performs the color control operation for the LED lighting device, the user needs to rotate back and forth the knob of the dimmer from clockwise 120 degrees to counterclockwise 120 degrees (a specific angle can be adjusted according to different dimmers) within 1-2 seconds, or the user needs to rotate back and forth the knob of the dimmer from counterclockwise 120 degrees to clockwise 120 degrees within 1-2 seconds. Therefore, the phase of the dimmer changes from large to small and from small to large in a short period of time, or the phase of the dimmer changes from small to large and from large to small within the short period of time. The phase change generated when the knob of the dimmer rotates is converted to the change of pulse width of the square wave through the Schmitt trigger 21. The changing square wave signal is transmitted to the digital control unit 22. The digital control unit 22 identifies amplitude and rate of the phase change of the dimmer 2 by collecting length data of the pulse width of the square wave and algorithm analysis, thereby controlling the second transistor 14 and the third transistor 15 to be turned on and turned off. Therefore, two rows of lighting devices with different colors are turned on and turned off alternatively, realizing color changes.

If the dimmer 2 is a sliding type phase cut dimmer, when performing the color control operation for the LED lighting device, the user only needs to slide the dimmer 2 and make the phase of the dimmer change from large to small or from small to large in a short period of time. Therefore, the user can adjust the color of the LED lighting device by using the conventional dimmer, and the user can also adjust the brightness for different colors of the LED lighting device by using the conventional dimmer.

Further, the dimmer can also be integrated with a mechanical switch. The digital control unit 22 controls the second transistor and the third transistor to be turned on and turned off through determining whether the number of times of continuously and rapidly turning on and turning off the mechanical switch exceeds a specified number of times in a set period of time, such that the color of the LED lighting device is changed.

The specified number of times of turning on and turning off the mechanical switch in the set period of time can be changed according to actual needs. For example, two times of turning on and turning off operation in 2 seconds can be set as a threshold. Under the circumstance that the switch is turned on, the switch is turned off and then turned on can be counted as 1 time of turning on/off operation. If the user performs 3 or more times of continuously turning on/turning off operations in 2 seconds (that is, the user rapidly turns on and turns off the switch), all parameters of the system is reset to preset values, and the color of the LED lighting device is an initial preset fixed color (e.g., cool white). If the number of times of continuously and rapidly turning on and turning off the switch does not exceeds the specified number of times in the set period of time (for example, a user performs only 1 time of continuously turning on/turning off operation), the digital control unit determines operating status of the previous circuit. If the operating status of the previous circuit is fixed color status, the digital control unit changes the current status and controls the second transistor 14 and the third transistor 15 to change the current switching status, thereby changing the color of the LED lighting device.

In addition, two rows of LED lighting devices are set in the present embodiment and the two rows of LED lighting devices correspond to the transistor 14 and the transistor 15, respectively. In addition, according to accrual needs, multiple rows of LED lighting devices can be set and the multiple rows of LED lighting devices correspond to multiple transistors.

Figure 4:
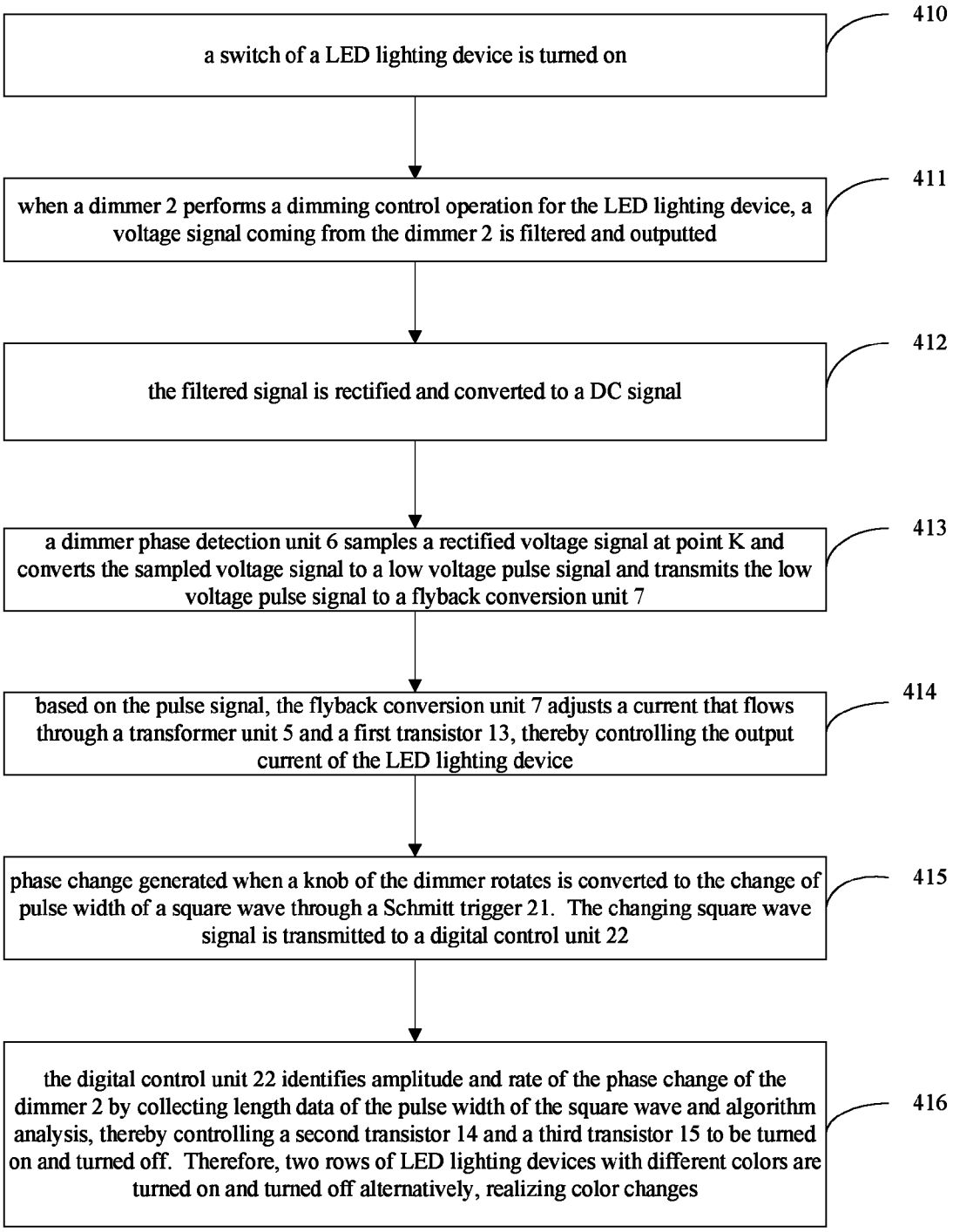
FIG. 4 illustrates a flow chart of another exemplary LED driving method consistent with the disclosed embodiments.

FIG. 4 illustrates a flow chart of another exemplary LED powering method consistent with the disclosed embodiments. As shown in FIG. 4, the process may include the following steps.

Step 410: a switch of an LED lighting device is turned on.

Step 411: when a dimmer 2 performs a dimming control operation for the LED lighting device, a voltage signal coming from the dimmer 2 is filtered and outputted.

Step 412: the filtered signal is rectified and converted to a DC signal.

Step 413: a dimmer phase detection unit 6 samples a rectified voltage signal at point K and converts the sampled voltage signal to a low voltage pulse signal and transmits the low voltage pulse signal to a flyback conversion unit 7.

Step 414: based on the pulse signal, the flyback conversion unit 7 adjusts the magnitude of a current that flows through a transformer unit 5 and a first transistor 13, thereby controlling the magnitude of the output current of the LED lighting device.

Step 415: phase change generated when a knob of the dimmer rotates is converted to the change of pulse width of a square wave through a Schmitt trigger 21. The changing square wave signal is transmitted to a digital control unit 22.

Step 416: the digital control unit 22 identifies amplitude and rate of the phase change of the dimmer 2 by collecting length data of the pulse width of the square wave and algorithm analysis, thereby controlling a second transistor 14 and a third transistor 15 to be turned on and turned off. Therefore, two rows of LED lighting devices with different colors are turned on and turned off alternatively, realizing color changes.

Note that, the term "comprising", "including" or any other variants thereof are intended to cover a non-exclusive inclusion, such that the process, method, article, or apparatus containing a number of elements also include not only those elements, but also other elements that are not expressly listed; or further include inherent elements of the process, method, article or apparatus. Without further restrictions, the statement "includes a . . . " does not exclude other elements included in the process, method, article, or apparatus having those elements.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

A power circuit for an LED lighting device including an AC power supply, a dimmer and a control circuit is provided. The control circuit includes a filtering unit configured to filter a voltage signal coming from the dimmer and a rectifying unit configured to receive the signal outputted from the filtering unit and rectify the signal to a DC signal. The control circuit also includes a transformer unit connected to the rectifying unit. Further, the control circuit includes a dimmer phase detection unit configured to sample the rectified voltage signal at point K and convert the voltage signal to a low voltage pulse signal and a flyback conversion unit configured to receive the pulse signal outputted by the dimmer phase detection unit and adjust the magnitude of a current flowed through the transformer unit and a first transistor to control the magnitude of the output current of the LED lighting device based on the pulse signal, where one end of the flyback conversion unit is connected to the dimmer phase detection unit, and the other end of the flyback conversion unit is connected to the first transistor and a primary coil of the transformer unit.

Compared with existing technologies, the power circuit does not need to change layout of current LED lighting devices. The LED lighting device can directly take place of a traditional LED lighting source such as an incandescent lamp and a halogen tungsten lamp. The LED lighting device is convenient to install, and can control light and the color of the LED lighting device through an existing dimmer.

REFERENCE SIGN LIST

AC power supply 1
Dimmer 2
Filtering unit 3
Rectifying unit 4
Transformer unit 5
Dimmer phase detection unit 6
Flyback conversion unit 7
Dimmer phase conversion rate detection unit 8

Opto-isolator 9
Color control unit 10
Control circuit 12
First transistor 13
Second transistor 14
Third transistor 15
Schmitt trigger 21
Digital control unit 22

What is claimed is:

1. A power circuit for a light emitting diode (LED) lighting device including an alternative current (AC) power supply, a dimmer and a control circuit, wherein the control circuit includes:

a filtering unit configured to filter a voltage signal coming from the dimmer and output a filtered voltage signal;

a rectifying unit configured to:

receive the signal outputted from the filtering unit;

rectify the signal to a direct current signal; and output the direct current signal;

a transformer unit, including a primary coil and a secondary coil, connected to the rectifying unit;

a dimmer phase detection unit configured to:

sample a rectified voltage signal;

convert the sampled voltage signal to a low voltage pulse signal; and output the converted low voltage pulse signal; and a flyback conversion unit configured to:

receive the pulse signal outputted by the dimmer phase detection unit; and based on the pulse signal, adjust a current flowed through the transformer unit and a first transistor to control the output current of the LED lighting device;

wherein the control circuit further includes:

a dimmer phase conversion rate detection unit configured to: detect a voltage; compare the detected voltage with a reference voltage; and output a pulse signal to a color control unit;

the color control unit configured to, based on duty cycle change of the pulse signal within a certain period of time, control a second transistor and a third transistor to be turned on and turned off, such that controlling a color status of the LED lighting device; and at least two transistors including the second transistor and the third transistor corresponding to different rows of LED lighting devices of different colors.

2. The power circuit according to claim 1, wherein one end of the flyback conversion unit is connected to the dimmer phase detection unit and the other end of the flyback conversion unit is connected to the first transistor and the primary coil of the transformer unit.

3. The power circuit according to claim 1, wherein:

the first transistor is a field effect transistor including a grid electrode, a drain electrode and a source electrode;

the grid electrode of the first transistor is connected to the flyback conversion unit; and the drain electrode of the first transistor is connected to the primary coil of the transformer unit.

4. The power circuit according to claim 1, wherein the control circuit further includes:

an opto-isolator configured to provide electrical isolation, wherein the pulse signal outputted by the dimmer phase conversion rate detection unit is transmitted to the color control unit through the opto-isolator.

5. The power circuit according to claim 1, wherein:

the second transistor and the third transistor are field effect transistors including a grid electrode, a drain electrode and a source electrode;

the grid electrodes of the second transistor and the third transistor are connected to the color control unit; and the drain electrodes of the second transistor and the third transistor are connected to the LED lighting device.

6. The power circuit according to claim 1, wherein the control circuit further includes:

a Schmitt trigger configured to convert phase change generated when a knob of the dimmer rotates to the change of pulse width of a square wave, wherein the changing square wave signal is transmitted to a digital control unit;

the digital control unit configured to identify amplitude and rate of the phase change of the dimmer by collecting length data of the pulse width of the square wave and algorithm analysis, thereby turning on and turning off a second transistor and a third transistor; and at least two transistors including the second transistor and the third transistor corresponding to LED lighting devices with different colors.

7. The power circuit according to claim 6, wherein:

the square wave signal outputted by the Schmitt trigger is transmitted to the digital control unit through the opto-isolator.

8. The power circuit according to claim 6, wherein:

the dimmer is integrated with a mechanical switch; and the digital control unit controls the second transistor and the third transistor to be turned on and turned off by determining whether the number of times of continuously and rapidly turning on and turning off the mechanical switch exceeds a specified number of times in a set period of time, such that the color of the LED lighting device is changed.

9. A method for powering up an LED lighting device, comprising:

turning on a power supply switch of the LED lighting device;

filtering a voltage signal coming from a dimmer and outputting the filtered voltage signal when performing a dimming control operation for the LED lighting device;

rectifying the outputted voltage signal to a direct current signal;

sampling a rectified voltage signal;

converting the sampled voltage signal to a low voltage pulse signal;

transmitting the low voltage pulse signal to a flyback conversion unit; and adjusting a current flowed through a transformer unit and a first transistor by the flyback conversion unit based on the pulse signal, thereby controlling the output current of the LED lighting device;

wherein:

when phase of the dimmer is changed in a short period of time, duty cycle of the pulse signal outputted by the dimmer phase conversion rate detection unit is also changed in the short period of time; and based on duty cycle change of the pulse signal in the short period of time, the color control unit controls the second transistor and the third transistor to be turned on and turned off, thereby controlling the color status of the LED lighting device.

10. The method according to claim 9, wherein: when performing a color control operation for the LED lighting device, a dimmer phase conversion rate detection unit detects a voltage and outputs a pulse signal to a color control unit after comparing the detected voltage with a reference voltage.

11. The method according to claim 9, further including:

adjusting, based on the pulse signal, operating pulse width of the flyback conversion unit and adjusting a current flowed through a transformer unit and a first transistor by the flyback conversion unit to control the output current of the LED lighting device.

12. The method according to claim 11, further including:

converting phase change generated when a knob of the dimmer rotates to the change of pulse width of a square wave through a Schmitt trigger when performing a color control operation for the LED lighting device, wherein:

the changing square wave signal is transmitted to a digital control unit; and the digital control unit identifies amplitude and rate of the phase change of the dimmer by collecting length data of the pulse width of the square wave and algorithm analysis to turn on and turn off a second transistor and a third transistor, realizing color change of the LED lighting device.

13. The method according to claim 12, wherein:

the dimmer is integrated with a mechanical switch.

14. The method according to claim 13, wherein:

the digital control unit controls the second transistor and the third transistor to be turned on and turned off through determining whether the number of times of continuously and rapidly turning on and turning off the mechanical switch exceeds a specified number of times in a set period of time, such that the color of the LED lighting device is changed.

15. A power circuit for a light emitting diode (LED) lighting device including an alternative current (AC) power supply, a dimmer and a control circuit, wherein the control circuit includes:

a filtering unit configured to filter a voltage signal coming from the dimmer and output a filtered voltage signal;

a rectifying unit configured to receive the signal outputted from the filtering unit and output a direct current signal;

a transformer unit, including a primary coil and a secondary coil;

a dimmer phase detection unit configured to sample a rectified voltage signal and output a converted low voltage pulse signal; and a flyback conversion unit configured to receive the pulse signal outputted by the dimmer phase detection unit and adjust a current flowed through the transformer unit and a first transistor to control the output current of the LED lighting device accordingly;

wherein the control circuit further includes:

a Schmitt trigger configured to convert phase change generated when a knob of the dimmer rotates to the change of pulse width of a square wave;

a digital control unit configured to receive the changing square wave signal, identify amplitude and rate of the phase change of the dimmer by collecting length data of the pulse width of the square wave and algorithm analysis, and turn on and turn off a second transistor and a third transistor; and at least two transistors including the second transistor and the third transistor controlling LED lighting devices with different colors.

* * * * *